United States Patent [19]

Hope, Sr. et al.

[11] 4,357,791

[45] Nov. 9, 1982

[54] NOISE AND VIBRATION DAMPENING RING MOUNT

[75] Inventors: William K. Hope, Sr.; David C. Frederick, both of Gastonia, N.C.

[73] Assignee: Hope Plastics Corporation, Gastonia, N.C.

[21] Appl. No.: 243,139

[22] Filed: Mar. 12, 1981

[51] Int. Cl.[3] ..... D01H 7/64

[52] U.S. Cl. ..... 57/122; 57/119

[58] Field of Search ..... 57/119, 120, 122, 124, 57/1 R

[56] References Cited

U.S. PATENT DOCUMENTS

| | | | |
|---|---|---|---|
| 2,454,707 | 11/1948 | Meyers et al. | 57/122 |
| 3,056,251 | 10/1962 | Keight | 57/122 |
| 3,093,957 | 6/1963 | Tetreault | 57/122 |
| 3,974,634 | 8/1976 | McCall et al. | 57/122 X |
| 4,302,927 | 12/1981 | Hope, Sr. | 57/122 |

*Primary Examiner*—John Petrakes

*Attorney, Agent, or Firm*—Bell, Seltzer, Park & Gibson

[57] ABSTRACT

The ring mount is of a two-piece construction and includes a hard plastic mounting support fixed in an annular opening in the ring rail. An annular recess is provided in the upper inner portion of the mounting support. A soft plastic insert is adapted to closely fit within the annular recess of the mounting support and is provided with an annular groove in the inner surface which is adapted to receive and support the lower flange of the ring. The two-piece ring mount is positioned between the metallic ring rail and the metallic ring and provides noise and vibration dampening means for resiliently supporting the metallic ring on the ring rail.

10 Claims, 3 Drawing Figures

NOISE AND VIBRATION DAMPENING RING MOUNT

FIELD OF THE INVENTION

This invention relates generally to a noise and vibration dampening ring mount for textile machines, such as spinning and twisting frames, and more particularly to a two-piece ring mount which is formed of molded plastic and includes a hard plastic support and a soft plastic insert for resiliently supporting the ring.

BACKGROUND OF THE INVENTION

Conventional types of spinning and twisting frames are provided with a metallic ring rail having a plurality of spaced apart annular openings which surround the yarn bobbins on which the yarn is to be wound. A metallic ring, provided with a traveler, is supported by a metallic mounting bracket on the ring rail. The metal-to-metal contact between the ring rail, the mounting bracket, the ring, and the traveler, provides a good conductor for the transmittal of noise and vibration between the parts and the noise can reach sufficient levels that it is necessary for the spinning frame attendant to wear ear plugs or the like.

U.S. Pat. No. 3,056,251 discloses a single-piece ring mount with an integrally molded traveler supporting ring which is said to be inexpensive to produce and which eliminates the need for an expensive lubricating system for periodically applying an oil or other lubricant to the ring. The formation of the ring of plastic material, as disclosed in this patent, does not provide the long ring life of a metal ring.

U.S. Pat. Nos. 2,454,707; 3,093,957 and 3,974,634 disclose the use of a single-piece rubber or plastic ring support positioned in the opening of the ring rail and supporting the metallic ring. When these single-piece molded ring holders are molded of material which is sufficiently resilient to provide a noise and vibration dampening function, the material is not sufficiently stiff or hard to provide a secure attachment in the opening of the ring rail.

SUMMARY OF THE INVENTION

With the foregoing in mind, it is an object of the present invention to provide a two-piece noise and vibration dampening ring mount which includes a hard plastic mounting support fixed in the opening of the ring rail and a soft plastic insert carried by the hard plastic mounting support and in turn supporting the metallic ring therein. The hard plastic mounting support provides a firm base for the soft plastic insert and the metallic ring may be easily removed and replaced when worn. The hard plastic mounting support and the soft plastic insert cooperate to provide a noise and vibration dampening connection between the metallic ring and ring rail.

In accordance with the present invention, the hard plastic mounting support is molded of a thermoplastic material, such as nylon, and includes a depending annular sleeve with an outer circumference adapted to closely fit within the annular opening of the ring rail. An enlarged support member extends upwardly above the upper surface of the ring rail and an annular shoulder extends inwardly from the enlarged support member and is adapted to rest on the upper surface of the ring rail. An annular recess extends around the upper portion of the inner surface of the enlarged support member for supporting the outer annular circumference of the molded soft plastic insert therein.

The soft plastic insert is molded of a softer and more resilient material than the hard plastic mounting support, such as vinyl. An annular groove is formed in the inner surface of the soft plastic insert and is adapted to receive and retain the lower flange of the metallic ring therein. The hard plastic mounting support and the soft plastic insert are positioned between the metallic ring rail and the metallic ring and provide noise and vibration dampening means for resiliently supporting the metallic ring.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
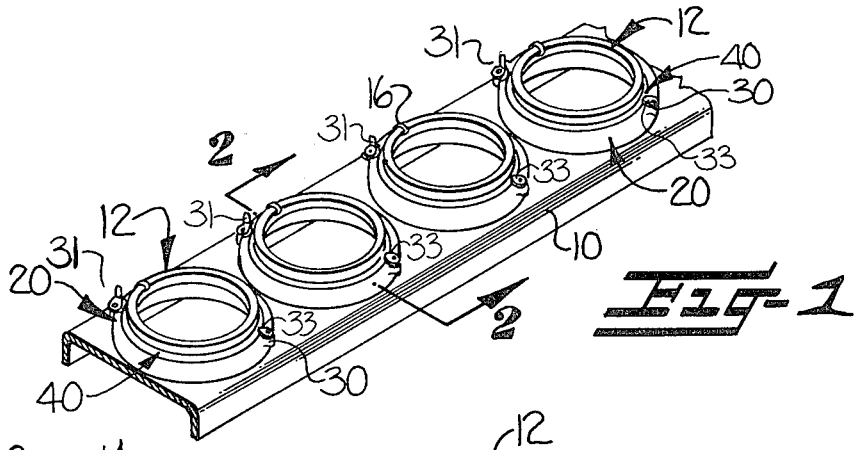
FIG. 1 is a fragmentary isometric view of a portion of the ring rail of the spinning frame and showing a plurality of the present type of two-piece ring mounts positioned therein.

As shown in FIG. 1, the ring rail 10 is of the conventional type used in a spinning frame and is provided with spaced apart annular openings 11 (FIGS. 2 and 3) suitably spaced to surround rotating bobbins (not shown) upon which thread is wound during the spinning operation. A metallic ring, broadly indicated at 12, is supported in each of the annular openings 11 and includes a main annular body 13 with respective upper and lower flanges 14, 15. A traveler 16 is supported on the upper flange 14 for rotational movement around the ring 12 in a conventional manner.

The improved noise and vibration dampening means for resiliently supporting the metallic ring 12 includes a molded hard plastic mounting support, broadly indicated at 20. The mounting support 20 includes a depending annular sleeve 21 with an outer circumference adapted to closely fit within the annular opening 11 of the ring rail 10. An enlarged support member 22 extends upwardly above the upper surface of the ring rail 10 and has an outer circumference which is larger than the opening 11 to provide an annular shoulder 23 extending inwardly from the enlarged support member 22 and adapted to rest on the upper surface of the ring rail 10. An annular recess 24 extends around the upper portion of the inner surface of the enlarged support member 22 and defines vertical and horizontal walls, for purposes to be presently described.

Figure 2:
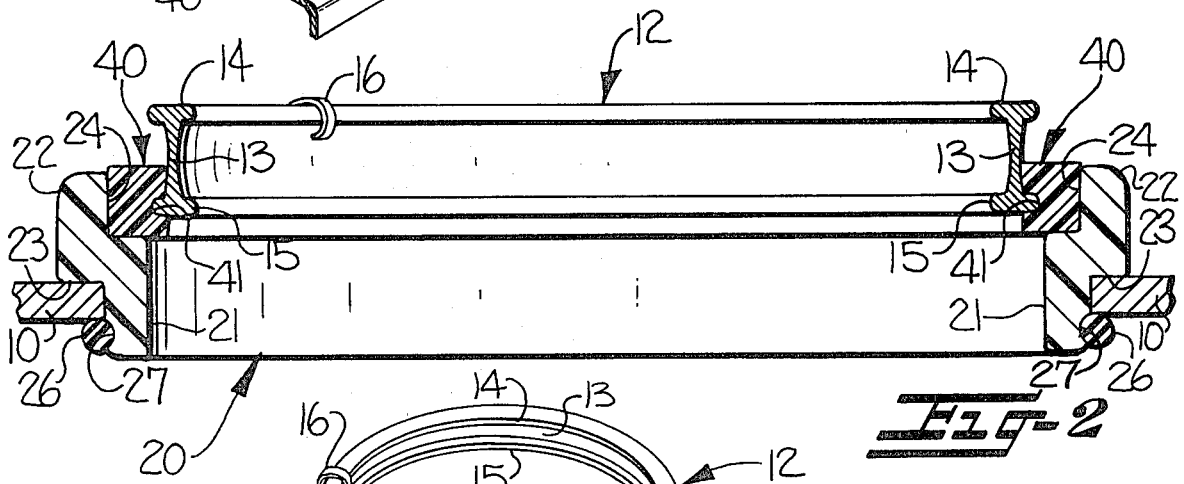
FIG. 2 is an enlarged vertical sectional view taken substantially along the line 2—2 in FIG. 1.

Means is provided for securing the mounting support 20 in the annular opening 11 of the ring rail 10 and is illustrated in FIG. 2 as being in the form of a resilient O-ring 26 which fits into a semi-circular groove 27 in the lower portion of the sleeve 21. When positioned in the manner shown in FIG. 2, the O-ring 26 bears against the lower surface of the ring rail 10 and surrounds the opening 11 to maintain the mounting support 20 in a fixed position in the ring rail 10. It is to be understood that other suitable means can be provided for maintaining the mounting support 20 in the ring rail, such as adhesive or a metallic lock ring.

Figure 3:
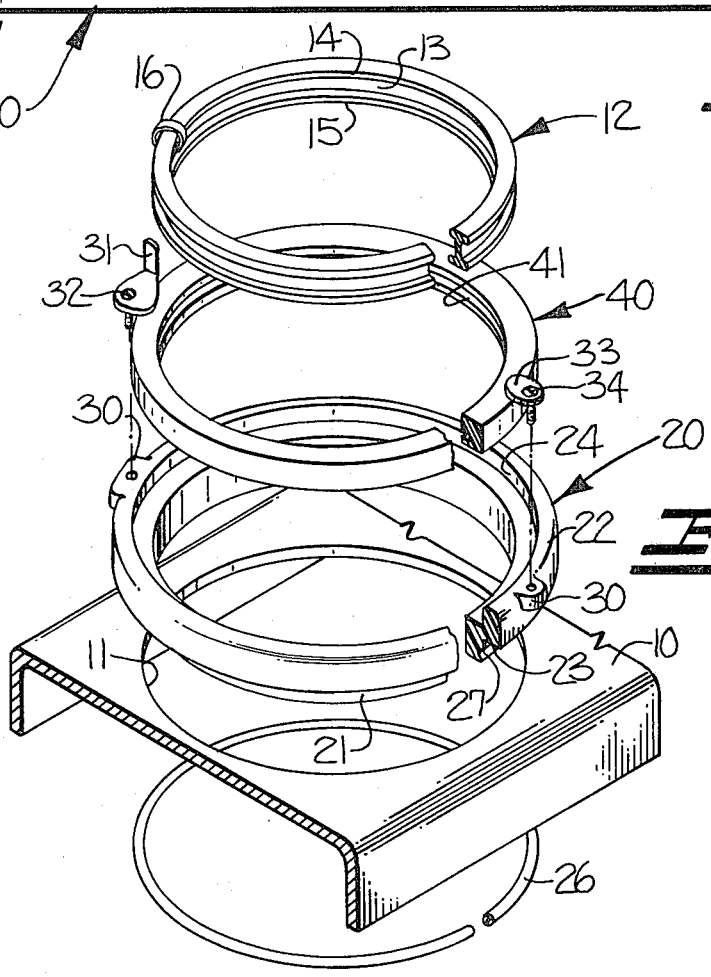
FIG. 3 is an exploded perspective view of the metallic ring and the two-piece ring mount of the present invention.

A pair of integrally molded ears or bosses 30 are provided on diametrically opposed sides of the mounting support 20. The bosses 30 are used to support a traveler cleaner, in the form of a metal angle clip 31. The horizontal leg of the clip 31 is suitably secured to one of the bosses 30 by a metal screw 32 (FIG. 3). The hard plastic mounting support 20 may be formed of a number of suitable materials, preferably having a Rockwell hardness (R scale) of from 80 to 130. A preferred class of such material is a thermoplastic material reinforced by the addition of glass fibers. A particular type of such material is Capron type 8231 (a trademark of Allied Chemical Corporation). Capron is an injection molding grade of type 6 nylon containing about 14% by weight of glass fibers, and having a Rockwell hardness (R scale) of 120. The mounting support 20 may be molded of other types of materials having similar characteristics.

A soft plastic insert, broadly indicated at 40, is provided with an annular outer circumference adapted to closely fit within the annular recess 24 of the enlarged support member 22, as illustrated in FIG. 2. When fitted within the recess 24, the upper surface of the insert 40 is substantially flush with the upper surface of the enlarged support member 22 and an annular groove 41 is provided in the inner surface of the insert 40 and is adapted to resiliently receive the outer portion of the lower flange 15 of the ring 12. The soft plastic insert 40 is preferably molded and may be formed of a number of suitable materials, such as natural or synthetic rubber, vinyl or the like and should be softer and more resilient than the material of which the mounting support 20 is molded. The hardness of the soft plastic insert 40 is preferably no more than 75% of the hardness of the hard plastic mounting support 20. A suitable insert has been injection molded of vinyl having a Rockwell hardness (R scale) of from 60 to 70. The insert 40 may be secured in the recess 24 as by a pressed fit or it may be adhesively secured in position.

The improved noise and vibration dampening two-piece molded ring mount of the present invention resiliently supports the metallic ring and includes a hard plastic mounting support 20 fixed on the ring rail 10 and a soft plastic insert 40 supported in the mounting support 20. The two-piece ring mount supports the metallic ring to provide noise and vibration dampening means between the metallic ring and the metallic ring rail. When it becomes necessary to replace the metalic ring 12, as when the ring 12 becomes worn, the insert 40 is simply removed from the mounting support 20 and placed on the lower flange of a new ring 12 and repositioned in the recess 24 of the mounting support 20. If desired, a new soft plastic insert 40 may be utilized when replacing the ring 12. Since the cost of producing the soft plastic insert 40 is very low, it may be desirable to provide a new soft plastic insert each time that it is necessary to replace the metallic ring 12.

It is preferred that the horizontal leg of the traveler cleaner 31 includes a portion which extends inwardly and overlies a portion of the upper surface of the soft plastic insert 40. The overlying portion of the traveler cleaner 31 maintains the soft plastic insert 40 in the annular recess 24 in the mounting support 20. Also, an offset washer 33 is secured to the other boss 30 by a metal screw 34 (FIG. 3) and a portion of the offset washer 33 overlies a portion of the upper surface of the soft plastic insert 40. The overlying portion of the offset washer 33 also aids in maintaining the soft plastic insert 40 in the annular recess 24 in the mounting support 20.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a spinning frame including a metallic ring rail with spaced apart annular openings therein, a metallic ring supported in each of said annular openings, said ring including a main body and upper and lower flanges, a traveler supported on said upper flange for rotational movement around said ring, the combination therewith of improved noise and vibration dampening ring mounting means supporting said metallic ring and comprising (a) a hard plastic mounting support, (b) means for securing said mounting support on said ring rail and surrounding said annular opening, (c) a soft plastic insert supported within said mounting support and including an annular groove in the inner surface of said insert for receiving and supporting said lower flange of said ring, wherein the hardness of said soft plastic insert is no more than 75% of the hardness of said hard plastic mounting support so that said hard plastic mounting support and said soft plastic insert are positioned between said metallic ring rail and said metallic ring and cooperate to provide noise and vibration dampening means for resiliently supporting said metallic ring on said ring rail.

2. In an apparatus according to claim 1 wherein said hard plastic mounting support includes a depending annular sleeve with an outer circumference adapted to closely fit within said annular opening of said ring rail, an enlarged support member extending upwardly above the upper surface of said ring rail, an annular shoulder extending inwardly from said enlarged support member and adapted to rest on the upper surface of said ring rail, and an annular recess extending around the upper portion of the inner surface of said enlarged support member, and wherein said soft plastic insert is supported in said annular recess of said enlarged support member.

3. In an apparatus according to claim 2 wherein said soft plastic insert includes an annular outer circumference adapted to closely fit within said annular recess of said enlarged support member.

4. In an apparatus according to claim 3 wherein said means for securing said mounting support on said ring rail comprises a semi-circular groove surrounding said annular sleeve, and a resilient O-ring supported in said semi-circular groove and in engagement with the lower surface of said ring rail.

5. In an apparatus according to claim 1 wherein said hard plastic mounting support is molded of nylon with glass filaments embedded therein.

6. In an apparatus according to claim 1 wherein said soft plastic insert is molded of vinyl.

7. In an apparatus according to claim 1 wherein said enlarged support member of said hard plastic mounting support includes an integrally formed boss, and including a traveler cleaner supported on said boss.

8. In an apparatus according to claim 7 wherein said traveler cleaner includes a horizontal leg with a portion of said horizontal leg extending over a portion of said soft plastic insert and maintaining said soft plastic insert in position in said hard plastic mounting support.

9. In an apparatus according to claim 8 including a second integrally formed boss on said hard plastic mounting, said second boss being located in diametrically opposed relationship to said first-named boss, and including a washer supported on said second boss and including a portion extending over a portion of said soft plastic insert and further aiding in maintaining said soft plastic insert in position in said hard plastic mounting support.

10. In an apparatus according to claim 1 wherein said hard plastic mounting support is molded of nylon and has a Rockwell hardness (R scale) of from 80 to 120, and wherein said soft plastic insert is molded of vinyl and has a Rockwell (R scale) hardness of from 60 to 70.

* * * * *